US008998753B2

(12) United States Patent
Tinti

(10) Patent No.: US 8,998,753 B2
(45) Date of Patent: Apr. 7, 2015

(54) HAND IMPLEMENT VIBRATION ISOLATION SYSTEM

(76) Inventor: Robert Tinti, Torrance, CA (US)

( * ) Notice: Subject to any disclaimer, the term of this patent is extended or adjusted under 35 U.S.C. 154(b) by 1082 days.

(21) Appl. No.: 12/387,853

(22) Filed: May 7, 2009

(65) Prior Publication Data

US 2009/0280932 A1 Nov. 12, 2009

Related U.S. Application Data

(60) Provisional application No. 61/126,692, filed on May 7, 2008, provisional application No. 61/192,358, filed on Sep. 18, 2008.

(51) Int. Cl.

| | |
|---|---|
| ***A63B 59/06*** | (2006.01) |
| ***A63B 49/00*** | (2006.01) |
| ***A63B 59/00*** | (2006.01) |

(52) U.S. Cl.

CPC ..... *A63B 59/0092* (2013.01); *A63B 59/0014* (2013.01); *A63B 2209/00* (2013.01)

(58) Field of Classification Search

USPC ..... 473/457, 519, 520, 568, 560, 561, 473/300–303, 549–552

See application file for complete search history.

(56) References Cited

U.S. PATENT DOCUMENTS

| | | | | |
|---|---|---|---|---|
| 1,212,038 | A * | 1/1917 | Flaxman | 473/44 |
| 3,941,380 | A | 3/1976 | Lacoste | |
| 4,105,205 | A | 8/1978 | Theodores et al. | |
| 4,248,425 | A | 2/1981 | Easton et al. | |
| 4,660,832 | A * | 4/1987 | Shomo | 16/431 |
| 4,951,948 | A | 8/1990 | Peng | |
| 5,131,652 | A * | 7/1992 | Peng | 473/523 |
| 5,180,163 | A | 1/1993 | Lanctot et al. | |
| 5,322,280 | A * | 6/1994 | Wu | 473/523 |
| RE34,767 | E * | 10/1994 | Soong | 473/300 |
| 5,362,046 | A | 11/1994 | Sims | |
| 5,511,777 | A | 4/1996 | McNeely | |
| 5,516,097 | A | 5/1996 | Huddleston | |
| 5,524,884 | A * | 6/1996 | Haines | 473/521 |
| 5,593,158 | A | 1/1997 | Filice et al. | |
| 5,624,114 | A | 4/1997 | Kelsey | |
| 5,653,643 | A | 8/1997 | Falone et al. | |
| 5,655,975 | A * | 8/1997 | Nashif | 473/316 |
| 5,655,980 | A | 8/1997 | Nashif et al. | |
| 5,692,971 | A | 12/1997 | Williams | |
| 5,711,728 | A | 1/1998 | Marcelo | |
| 5,772,541 | A | 6/1998 | Buiatti | |
| 6,007,439 | A | 12/1999 | MacKay, Jr. | |
| 6,056,646 | A * | 5/2000 | Soong | 473/298 |
| 6,086,490 | A * | 7/2000 | Spangler et al. | 473/564 |
| 6,234,920 | B1 | 5/2001 | Wang | |
| 6,652,398 | B2 | 11/2003 | Falone et al. | |
| 6,837,812 | B2 | 1/2005 | Falone et al. | |
| 6,863,629 | B2 | 3/2005 | Falone et al. | |
| 6,872,157 | B2 | 3/2005 | Falone et al. | |
| 6,893,366 | B2 | 5/2005 | Falone et al. | |
| 6,935,973 | B2 | 8/2005 | Falone et al. | |
| 6,942,586 | B2 | 9/2005 | Falone et al. | |
| 7,201,679 | B2 | 4/2007 | Nguyen | |
| 2003/0224870 | A1 * | 12/2003 | Soong | 473/318 |
| 2010/0184540 | A1 * | 7/2010 | Sims et al. | 473/564 |

* cited by examiner

*Primary Examiner* — Mark Graham

(57) ABSTRACT

A vibration isolation system for hand implements including sporting equipment and tools to substantially reduce impact forces from being delivered to the user's hands. Isolation elements provide low spring rates enabling the system to isolate bending vibration, recoil, and twist. An outer shell member substantially encircles the grip end of the hand implement and is spaced outwardly thereto allowing the grip end to freely deflect within the outer shell member.

26 Claims, 9 Drawing Sheets

HAND IMPLEMENT VIBRATION ISOLATION SYSTEM

This application claims priority under 35 U.S.C. §119(e) of U.S. provisional patent application Ser. Nos. 61/126,692 and 61/192,358 filed on May 7, 2008 and Sep. 9, 2008 respectively, and entitled "Baseball/softball bat and tool handle/grip shock/vibration isolator system" and "Baseball/Softball bat and tool handle/grip shock/Vibration isolator system" respectively, the disclosures of both of which are hereby incorporated herein by reference.

FIELD OF THE INVENTION

The invention relates in general to hand implements used to impact objects. More specifically, the invention relates to a vibration isolation system for use on sporting equipment and tools to substantially reduce impact forces from being delivered to the user's hands.

BACKGROUND OF THE INVENTION

Hand implements used to impact objects generate vibrational forces that are transmitted to the user's hand(s). There have been numerous attempts to reduce the transmission of these forces to the user's hand(s). With respect to baseball bats, one approach is to establish a vibration within the bat that is 180 degrees out of phase with natural vibration of the bat. An example of this approach is found in U.S. Pat. No. 5,772,541 to Buiatti, where a vibration dampening member is allowed to vibrate within the knob of the bat to dampen unwanted lower frequency vibration of the bat. Another approach is to provide a two piece bat connected along an interface with a continuous elastomeric union, as is found in U.S. Pat. No. 5,593,158 to Filice, et al., to prevent vibration from the barrel of the bat from being transmitted to the grip end of the bat. It is believed such continuous elastomeric unions establish unnecessarily high spring rates for the system, which are averse to isolating the transmission of vibrational forces. What is needed is to establish a vibration isolation system that has a very low spring rate for the system, and thereby isolate the transmission of vibrational forces to the user's hand(s).

BRIEF SUMMARY OF THE INVENTION

The present invention provides its benefits across a broad spectrum of hand implements. While the description which follows hereinafter pertaining to baseball bats and tennis rackets is meant to be representative of such applications, it is not exhaustive. It is intended that this specification and the claims appended hereto be accorded a breadth in keeping with the scope and spirit of the invention being disclosed despite what might appear to be limiting language imposed by the requirements of referring to the specific examples disclosed.

It is one aspect of the present invention to provide a vibration isolation system for hand implements that substantially reduces bending vibrational forces induced upon impact with an object from being transmitted to the user's hand(s).

It is another aspect of the present invention to provide a vibration isolation system for hand implements that minimizes the transmission of torsional forces induced upon impact with an object at a point offset from the centerline of the hand implement.

It is a feature of the present invention that an outer shell member is provided that substantially encircles and is spaced outwardly from the grip end of the hand implement.

It is another feature of the present invention that at least one isolation element is positioned between the grip end of the hand implement and the outer shell member.

It is still another feature of the present invention that the ratio of the fundamental bending natural frequency ($\omega$) divided by the natural frequency of the vibration isolation system ($\omega_o$) is greater than 1.5.

It is still yet another feature of the present invention that the ratio of the effective forcing frequency ($\omega_f$) divided by the torsional natural frequency of the vibration isolation system ($\omega_t$) is greater than 1.5

It is an advantage of the present invention that, by proper selection and location of isolation elements between the outer shell member and grip end, bending forces induced upon impact with an object are isolated from the user's hand.

It is another advantage of the present invention that, by proper selection and location of isolation elements between the outer shell member and grip end, torsional forces induced upon impact with an object at a point offset from the centerline of the hand implement are isolated from the users hand.

These and other aspects, features, and advantages are achieved/attained in the apparatus of the present invention that comprises a outer shell member having an inner surface substantially encircling and spaced outwardly from the grip end of a hand implement. The outer shell member sufficiently spaced outwardly from the grip end allowing the grip end to freely deflect within the outer shell member when the impact end of the hand implement impacts an object within an intended zone of contact. At least one isolation element is positioned between the grip end and the outer shell member and supporting the outer shell member about the grip end. The isolation element and outer shell member establish a spring rate (k) of the vibration isolation system when the system is affixed to the hand implement. The spring rate (k) and mass (m) of the hand implement define a natural frequency of the vibration isolation system ($\omega_o$), wherein the ratio of the fundamental bending natural frequency ($\omega$) divided by the natural frequency of the vibration isolation system ($\omega_o$) is greater than 1.5 By selecting materials for the isolation element that are very soft, a low spring rate (k) is achieved, which in turn allows the ratio ($\omega/\omega_o$) to be greater than 1.5, and assures that bending vibrational forces are substantially isolated from the users hand(s).

For hand implements which may strike on object a point offset from the centerline of the implement, torsional forces are also isolated according to the present invention vibration isolation system. First, an effective forcing frequency ($\omega_f$) based on the effective duration of impact with an object of the hand implement must be selected. With these values, and with the polar moment of inertia (J) of the hand implement about its centerline, a torsional spring rate ($K_t$) of the vibration isolation system affixed to the hand implement can be measured. A torsional natural frequency of the vibration isolation system ($\omega_t$) can be determined and if the ratio of the effective forcing frequency ($\omega_f$) divided by the torsional natural frequency of the vibration isolation system ($\omega_t$) is greater than 1.5, the transmission of torsional forces to the users hands are substantially isolated. By the appropriate selection of material and configuration of the isolation element an optimal torsional spring rate ($K_t$) is achieved, which in turn allows the ratio ($\omega_f/\omega_t$) to be greater than 1.5, and assures that torsional forces are substantially isolated from the user's hand(s).

BRIEF DESCRIPTION OF THE DRAWINGS

The aspects, features and advantages of the present invention will become apparent upon consideration of the following detailed disclosure of the invention, especially when it is taken in conjunction with the accompanying drawings wherein.

To facilitate understanding, identical reference numerals have been used, where possible, to designate identical elements or features common to the figures.

DETAILED DESCRIPTION OF THE PREFERRED EMBODIMENTS

Figure 1:
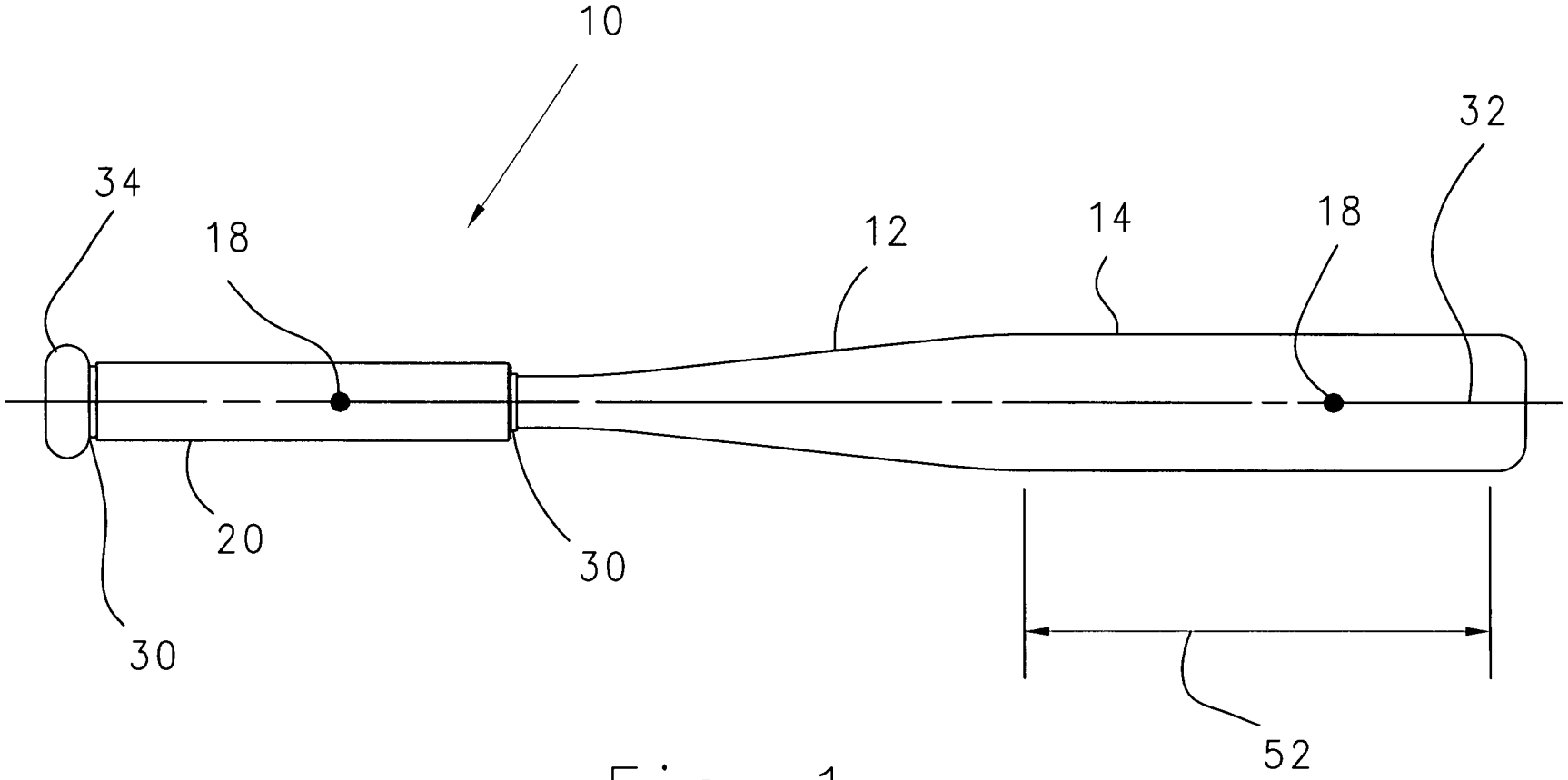
FIG. 1 is a side view of a vibration isolation system of the present invention on a baseball bat.
Figure 2:
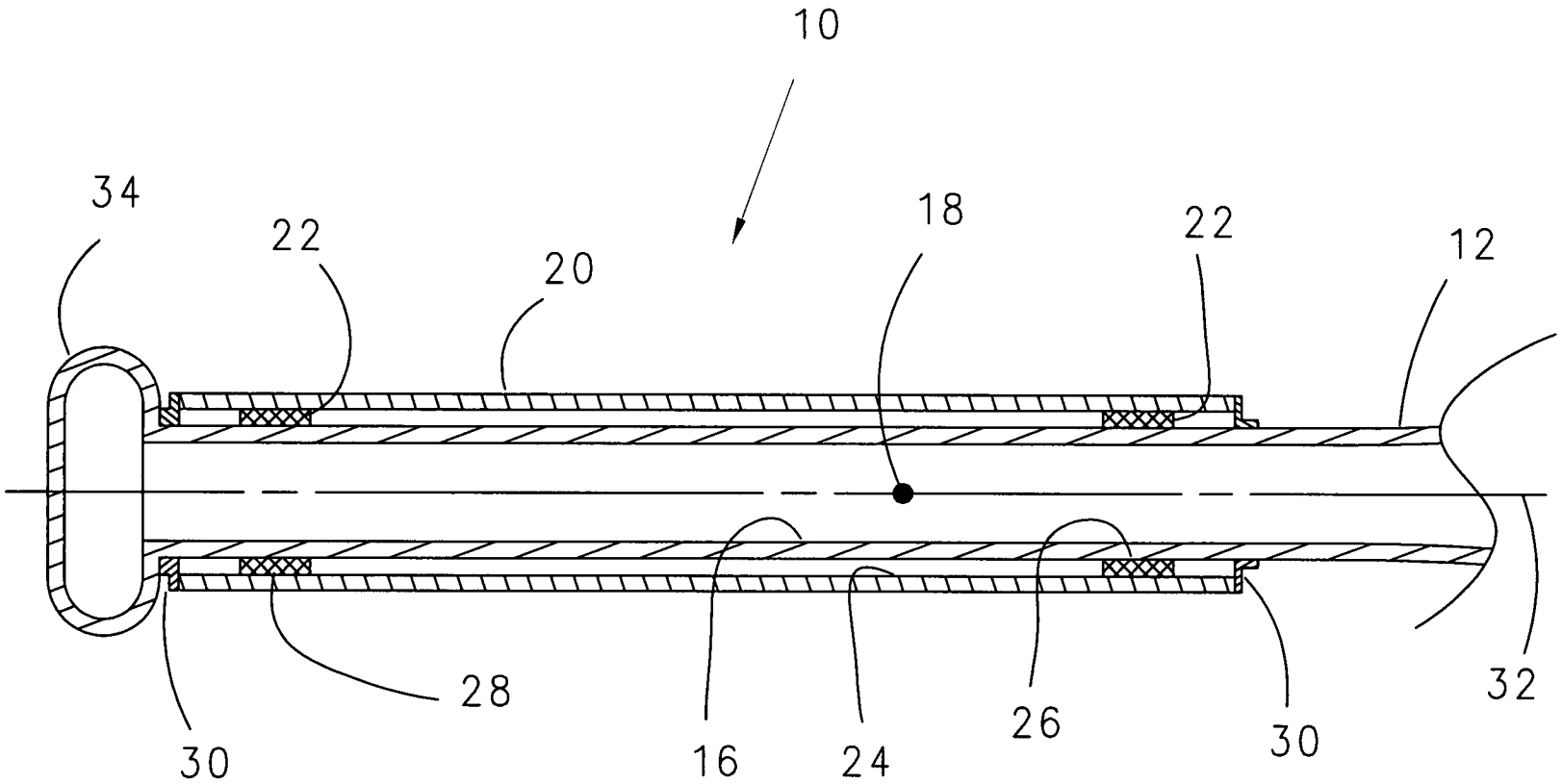
FIG. 2 is a cross-sectional view of the vibration isolation system of FIG. 1.

Referring to FIGS. 1 and 2, a vibration isolation system is shown generally by numeral 10 affixed to a hand implement 12. The hand implement 12, in this embodiment, is an aluminum baseball bat having an impact end 14 and a grip end 16. This embodiment illustrates the present invention in conjunction with hand implements which generally only strike objects at or near the centerline 32 of the implement. Such implements are subject predominately to bending vibrational forces. It is generally known that aluminum baseball bats have a mass (m) of around 16 ounces, and have a fundamental bending natural frequency (ω) of vibration of between about 200 to 600 Hz. Also shown in FIG. 1 are the fundamental node locations 18, of the first mode of vibration. At these locations there is essentially no deflection of the bat when it vibrates at the fundamental bending natural frequency (ω). When the batter hits a ball on the node location 18 on the impact end 14 of the bat, vibration of the bat is minimal. This is known as the "sweet spot," where little of no vibration is transmitted to the batters hands. When the batter hits a ball away from the "sweet spot," bending vibrational forces travel through the bat and are felt in the batters hands and the grip end 16 of the bat. The vibration isolation system 10 shown in FIGS. 1-3 substantially eliminates these forces from being transmitted to the batters hands.

In reality there are numerous modes of vibration. For purposes of the present invention, only the first three modes are considered to determine vibrational deflection along the grip end 16 of the implement in a perpendicular direction from the centerline 32 of the implement 12. The vibrational deflection for each of the first three modes are determined at various locations along the grip end 16, and then added together to establish a vibration deflection profile along the grip end 16. The following vibration deflection profile along the grip end 16 of a little league approved bat is shown in Table 1. Table 1 was produced based on a model YBCX13 Prodigy—13 bat, 29 inches long weighing 16 ounces, manufactured by Worth, Inc., of St. Louis, Mo.

TABLE 1

| Distance from knob of bat (x) | 1st Mode deflection ($y_1$) | 2nd Mode deflection ($y_2$) | 3rd Mode deflection ($y_3$) | Deflection sum ($y_1 + y_2 + y_3$) |
|---|---|---|---|---|
| 0.0 | 0.179 | 0.015 | 0.016 | 0.211 |
| 0.5 | 0.159 | 0.012 | 0.012 | 0.183 |
| 1.0 | 0.138 | 0.009 | 0.008 | 0.156 |
| 1.5 | 0.118 | 0.007 | 0.003 | 0.128 |
| 2.0 | 0.098 | 0.004 | 0.000 | 0.102 |
| 2.5 | 0.078 | 0.001 | −0.004 | 0.076 |
| 3.0 | 0.059 | −0.001 | −0.007 | 0.051 |
| 3.5 | 0.040 | −0.004 | −0.009 | 0.027 |
| 4.0 | 0.021 | −0.006 | −0.010 | 0.005 |
| 4.5 | 0.004 | −0.007 | −0.011 | −0.015 |
| 5.0 | −0.013 | −0.009 | −0.011 | −0.033 |
| 5.5 | −0.029 | −0.010 | −0.009 | −0.048 |
| 6.0 | −0.044 | −0.010 | −0.007 | −0.062 |
| 6.5 | −0.058 | −0.010 | −0.005 | −0.073 |
| 7.0 | −0.070 | −0.010 | −0.002 | −0.082 |
| 7.5 | −0.081 | −0.009 | 0.001 | −0.089 |
| 8.0 | −0.090 | −0.008 | 0.004 | −0.094 |
| 8.5 | −0.097 | −0.007 | 0.007 | −0.097 |
| 9.0 | −0.103 | −0.005 | 0.009 | −0.099 |
| 9.5 | −0.107 | −0.003 | 0.010 | −0.099 |
| 10.0 | −0.108 | −0.001 | 0.011 | −0.099 |
| 10.5 | −0.109 | 0.001 | 0.011 | −0.097 |
| 11.0 | −0.107 | 0.003 | 0.010 | −0.094 |

Referring to FIG. 2, the vibration isolation system 10 comprises an outer shell member 20 and isolation elements 22. The outer shell member 20 has an inner surface 24 substantially encircling and spaced outward from the grip end 16 of the bat. Further, the outer shell member 20 is sufficiently spaced outwardly from the grip end 16 allowing the grip end 16 to freely deflect within the outer shell member 20 when the impact end 14 of the hand implement impacts an object within an intended zone of contact 52. From the vibration deflection profile in Table 1, is was determined that a space or gap of about 0.090 inches is sufficient to allow the bat to vibrate without the grip end 16 contacting the outer shell member 20 for a little league approved aluminum bat. In the embodiment shown in FIGS. 1-2, the outer shell member 20 is a two piece shell that is adhesively bonded together about the bat, establishing an essentially rigid shell. The shell member 20 can be made from any substantially rigid material such as, for example, metal, plastic, hard rubber, and the like. A polycarbonate plastic tube having an internal diameter of 1.0 inch and a thickness of about 0.062 inches has shown to be satisfactory, with the two piece shell being bonded together with a urethane adhesive/sealant.

The isolation elements 22 have an inner mounting surface 26 and an outer mounting surface 28. The inner mounting surface 26 is affixed to the grip end 16 and the outer mounting surface 28 is affixed to the outer shell member 20. The isolation elements 22 may be adhesively affixed to the grip end 16 and outer shell member 20, or held in place by friction. Alternatively the isolation elements 22 may be bonded on one side and allowed to slide or held by friction on the other. It is critical to the present invention to select a very soft material for the isolation elements 22, so as to establish a low spring rate (k) of the vibration isolation system 10 as it is affixed to the bat. Materials such as elastomers, rubber, foam, plastic, and the like, may be used. Open cell ethylene vinyl acetate rubber 3 mm thick has proven to be a satisfactory material for the isolation elements 22, such as the material sold as Darice® Foamies 3 mm thick by Darice, Inc. of Strongsville Ohio, being affixed to the outer shell member 20 and grip end 16 with double sided tape. In addition, the "footprint" of the isolation elements, the length of contact they have along the outer shell member 20, must be relatively small compared to the length of the inner surface 24 along the outer shell member 20. For the isolation elements 22 in FIG. 2, the "footprint" of each isolation element is a length of about 0.50 inches wide and the length of the inner surface 24 of the outer shell member 20 is between about 6 to 9 inches wide. This leaves a significant unsupported gap between the outer shell member 20 and the grip end 16 allowing the grip end to freely deflect. It is to be appreciated that, even with a very soft material for the isolation element 22, if the "footprint" is too large, the extreme case the "footprint" being the entire length along the inner surface 24 of the outer shell member 20, the overall spring rate (k) of the system 10 may be too great and significantly hinder the ability of the system 10 to isolate vibration. It is believed that the length of the outer shell member 20 be at least 2 times greater than the footprint length of the isolation elements 22 to allow the grip end 16 to freely deflect within the outer shell member 20.

The isolation elements 22 cross-section may vary along its "footprint" length and also about the circumference of the element about the grip end. This may be done to optimize the vibration isolation system 10 by taking into account the vibration deflection profile for a given hand implement, and the node locations corresponding to the fundamental bending natural frequency (ω) of the hand implement, such as, for example, a golf club. It is to be appreciated that the cross-section of the isolation elements may vary depending on application, such as, for example, circular for a baseball bat, rectangular or octagonal for a tennis racket, or oval for a hammer.

Figure 9:
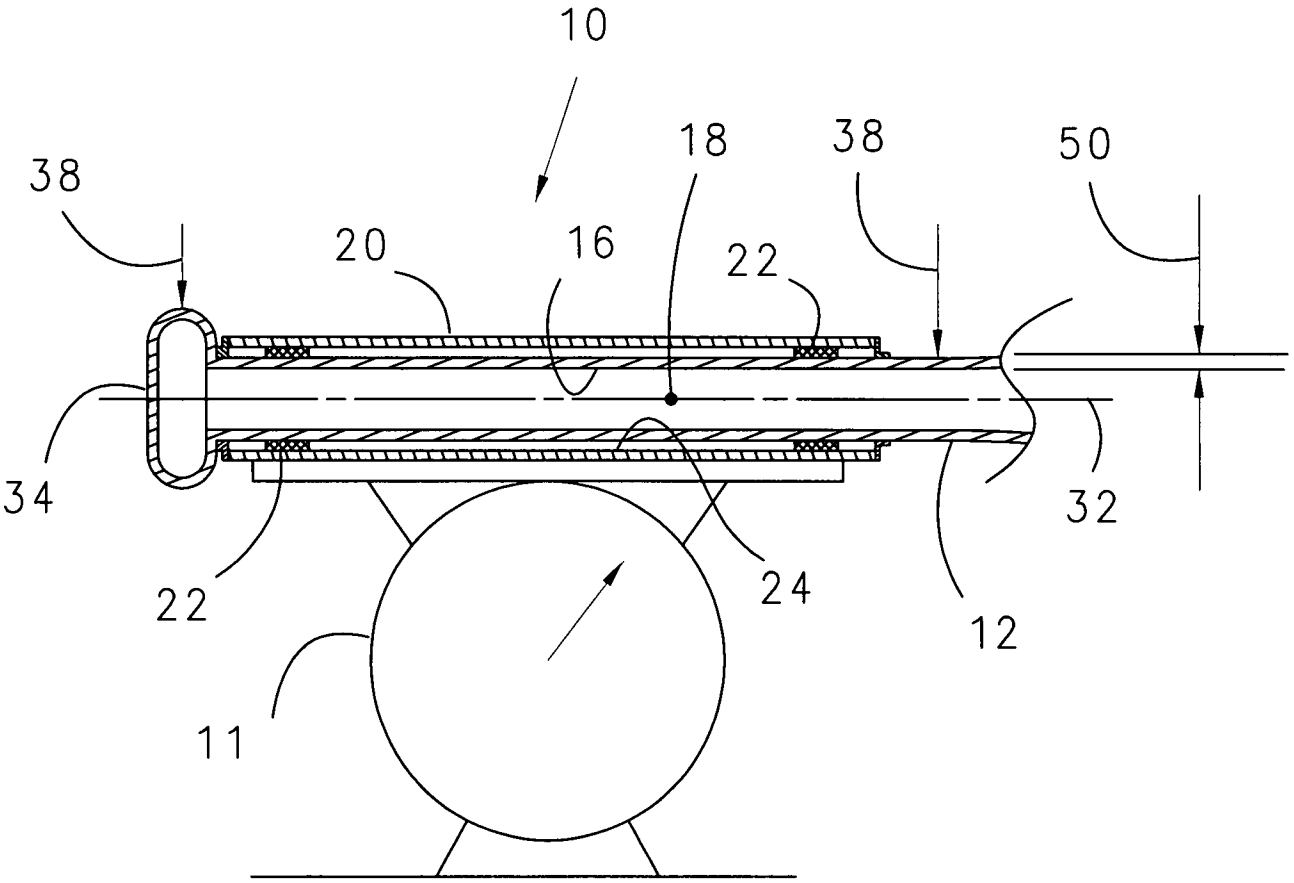
FIG. 9 is a side view of the vibration isolation system of FIG. 2 demonstrating the method of measuring the spring rate (k) of the system.

Referring to FIG. 9, the embodiment shown in FIGS. 1-2 is shown to illustrate how the spring rates (k) of the isolation elements 22 are measured. The outer shell member 20 is placed on scale 11 and a linear deflection (d) of the grip end 16 is measured under an evenly applied force (F) across the bat that is measured by scale 11. In FIG. 9, the linear deflection (d) of the grip end 16 is shown by numeral 50, and the sum of the evenly applied force (F) is provided at locations shown by numeral 38. The forces provided at locations 38 must be applied so that the grip end 16 deflects linearly, that is, there is no angular rotation of the centerline 32 of the implement 12. Preferably the spring rate (k) is measured along the direction in which the bat is intended to strike a ball. This also applies to any other hand implement that is intended to strike an object in a single direction, such as, for example, a wooden baseball bat, a tennis racket, a hammer, and the like. The spring rate (k) of the isolation elements 22 is determined by:

$$k=(F\div d)/\text{number of isolation elements in the system.}$$

In the embodiment shown, there are two isolation elements having the same "footprint" and the measured force divided by the deflection must be divided by 2. If there are three isolation elements, it would be divided by 3. According to the present invention, it is the spring rate of one isolation element that is to be determined for calculating the natural frequency of the vibration isolation system ($\omega_o$). This can be accomplished by cutting the implement apart around one isolation element, and measuring the spring rate as shown in FIG. 9.

It is to be appreciated that the spring rate of each isolation element 22 may vary depending on the vibration deflection profile and node locations 18 of the hand implement 12. For purposes of the present invention, the isolation element with the lowest spring rate (k) is to be considered in determining the natural frequency of the vibration isolation system ($\omega_o$). It is also to be appreciated that the spring rate of each isolation element 22 may vary depending on the direction in which the spring rate is measured on the implement. For purposes of the present invention, the spring rate is to be measured in the direction in which the hand implement is designed to strike an object.

With the spring rate (k) determined and the mass (m) of the bat known, a natural frequency of the vibration isolation system ($\omega_o$) is determined by:

$$\omega_o=(k\div m)^{1/2}$$

With the fundamental bending natural frequency (ω) of the bat known, and with the natural frequency of the vibration isolation system ($\omega_o$) determined, the ratio of the fundamental bending natural frequency (ω) divided by the natural frequency of the vibration isolation system ($\omega_o$) is determined. According to the present invention, this ratio ($\omega/\omega_o$) must be greater than 1.5. If this ratio ($\omega/\omega_o$) is less than about 1.5, too much vibration will be transmitted to the batters hand(s). If the ratio ($\omega/\omega_o$) is too low, it can be increased by reconfiguring the isolation elements 22 to obtain a lower spring rate (k) of the isolation elements. The isolation elements can be reconfigured by changing to a softer material, and/or by changing their "footprint" to a smaller length. It is preferred to configure the isolation elements 22 in the system 10 to obtain a ratio ($\omega/\omega_o$) of 2.0 or above, yet a value of 1.5 or above is sufficient. The greater the ratio ($\omega/\omega_o$), the greater vibration is isolated from the batters hand(s). For the embodiment shown in FIGS. 1-2, Table 2 shows the values that were obtained for a little league aluminum bat for the first three fundamental bending natural frequency modes.

TABLE 2

| | ω (rad/sec) | M (Ounces) | Impulse (lbf-sec) | K (lbf/in) | ωo (rad/sec) | (ω/ωo) |
|---|---|---|---|---|---|---|
| $1^{st}$ Mode | 2640 | 16 | 2000 | 280 | 329 | 8.0 |
| $2^{nd}$ Mode | 7277 | 16 | 2000 | 280 | 329 | 22.1 |
| $3^{rd}$ Mode | 14268 | 16 | 2000 | 280 | 329 | 43.4 |

When the ratio ($\omega/\omega_o$) (or forcing frequency/undamped natural frequency—as commonly known to those skilled in the art), increases beyond 1.5, absolute transmissibility ($T_A$) of vibration drops. The lower the absolute transmissibility, the less amount of vibration is transmitted through a damped or undamped system. Although the fraction of critical damping (ζ) of the system in conjunction with the ratio ($\omega/\omega_o$) determines the actual value of absolute transmissibility ($T_A$) of the system, absolute transmissibility ($T_A$) drops at a much greater rate in relation to the increase in the ratio ($\omega/\omega_o$). Hence, even without knowing the fraction of critical damping (ζ) of the system, when the ratio ($\omega/\omega_o$) is greater than 1.5, the absolute transmissibility ($T_A$) is sufficiently lowered for purposes of the present invention to minimize the transmission of vibration from a hand implement to the outer shell member 20 of the vibration isolation system 10. Yet an isolation element 22 with a low fraction of critical damping (ζ) is desirable for a lower transmissibility ($T_A$). As can be seen in Table 2, the ratio ($\omega/\omega_o$) of the $1^{st}$ fundamental mode of vibration is the lowest of the first three modes, and why, for purposes of the present invention, the fundamental bending natural frequency ratio (ω) of the $1^{st}$ fundamental mode of vibration is used in determining the ratio ($\omega/\omega_o$).

Figure 3:
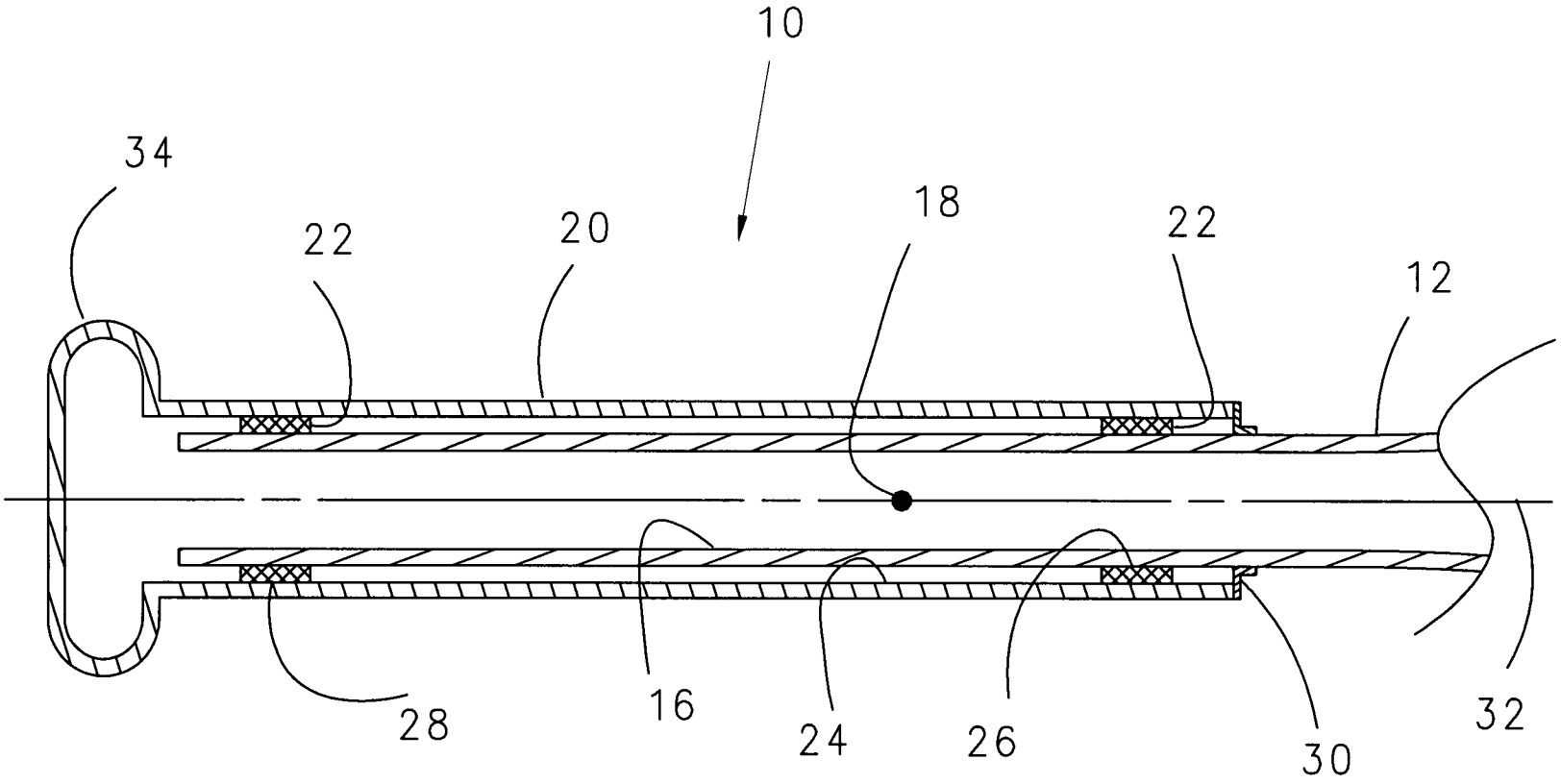
FIG. 3 is a cross-sectional view of an alternative embodiment of the present invention vibration isolation system for a baseball bat.

Referring to FIG. 3, an alternative embodiment of the vibration isolation system 10 is shown. In this embodiment, the outer shell member 20 is integral with the knob 34 of the bat. This allows the system to be affixed to the grip end 16 as a single piece, in contrast to the two piece shell design of the embodiment shown in FIGS. 1-2. In both embodiments, dust shields 30 are provided that are affixed to the grip end 16 to prevent particulates from getting embedded between the outer shell member 20 and the grip end 16. Such particulates would significantly alter the spring rate (k) of the system. Preferably these dust shields 30 are configured so as not to interfere with the movement between the shell member 20 and the grip end of the bat 16, and therefore have no impact on the spring rate (k) of the system.

Figure 4:
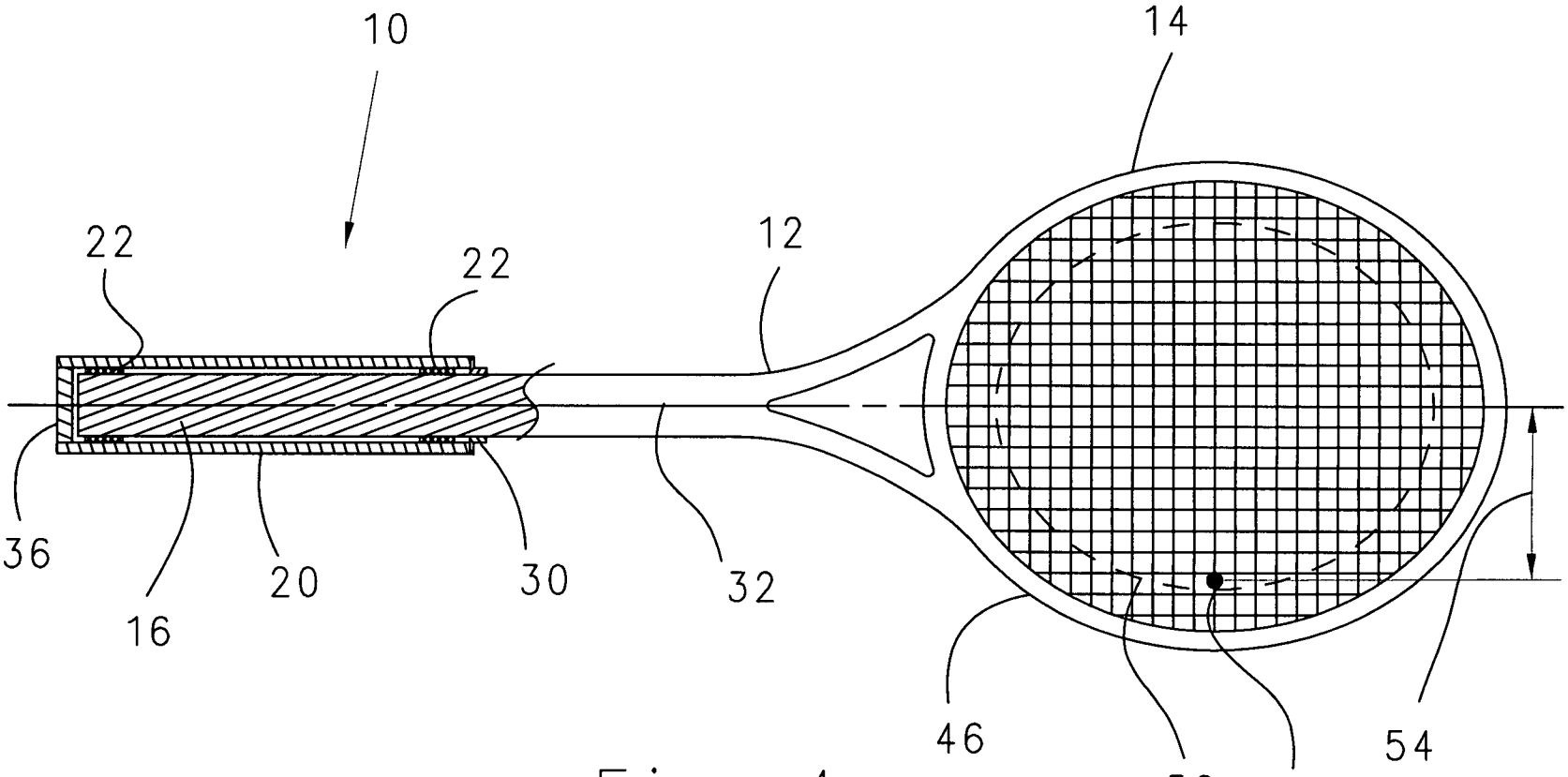
FIG. 4 is a partial cross-sectional side view of the vibration isolation system on a tennis racket.
Figure 5:
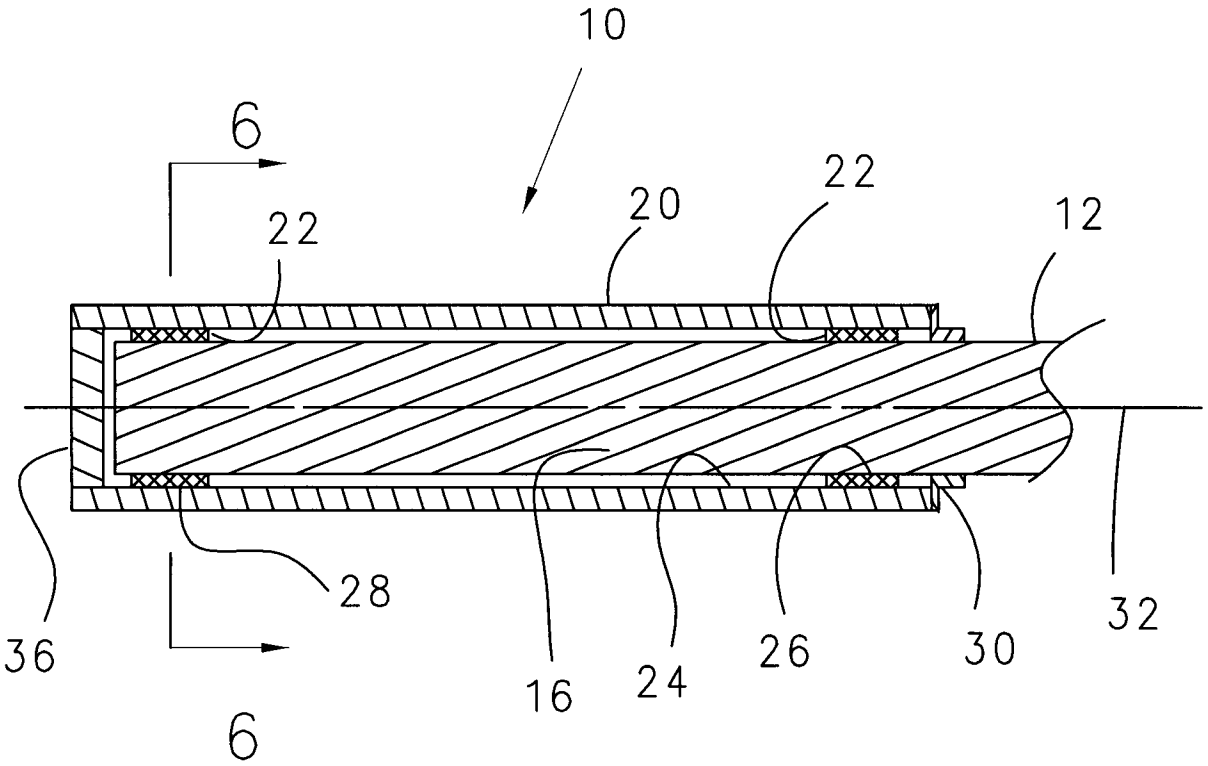
FIG. 5 is a cross-sectional view of the vibration isolation system of FIG. 4.
Figure 6:
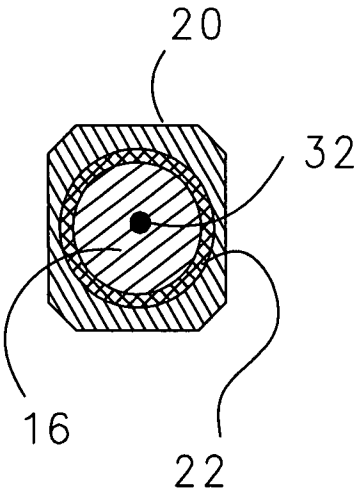
FIG. 6 is a cross-section view taken from FIG. 5.

Referring to FIGS. 4-6, an alternative embodiment of the present invention vibration isolation system 10 is shown. This embodiment is intended for hand implements which often strike an object at a distance offset from the centerline 32 of the implement within an intended zone of contact 52. For such implements, a torsional force is generated and transmitted to the users hand when an object is hit off center. For purposes of illustration, a tennis racket is used in this embodiment, in which the torsional forces generated from "off hit balls" results in what is commonly called "tennis elbow."

The vibration isolation system 10 of FIGS. 4-6 is similar to the previous embodiments, having an outer shell member 20, isolation elements 22, and dust shield 30, but the outer shell member 20 is configured to mimic the shape of a conventional tennis racket handle, and has an end cap 36 to seal the system from contamination on the end. The system 10 is predominantly configured to isolate torsional forces being transmitted to the player's hand. Hence, the outer shell member 20 is sufficiently spaced outwardly from the grip end 16 to allow the grip end 16 to torsionally deflect within the outer shell member 20. In order to configure the present invention vibration isolation system 10 for a tennis racket, the polar moment of inertia (J) about the centerline 32 of the racket, and an effective forcing frequency ($\omega_f$) of the racket need to be determined.

To those skilled in the art, determining the polar moment of inertia (J) of the tennis racket about the centerline 32 of the racket is well known. Values of the polar moment of inertia (J) will vary somewhat depending on the type and make of racket. The vibration isolation system of the present invention may be configured for a specific racket thereby utilizing a specific polar moment of inertia (J) measured for a specific racket, or an average value of the polar moment of inertia (J) for a number of rackets may be used. The same applies to the other parameters that have to be selected/determined according to the present invention.

Figure 10:
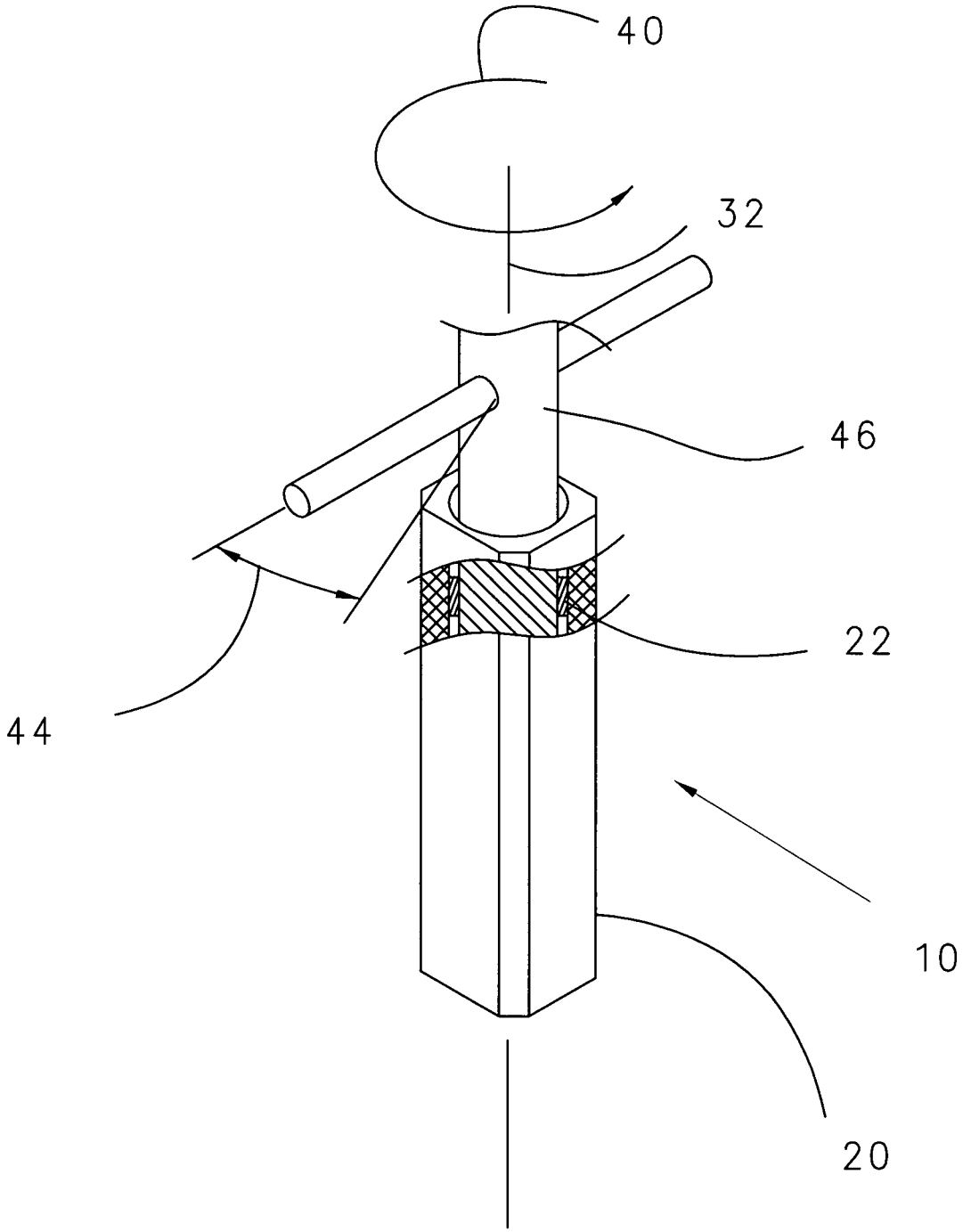
FIG. 10 is an isometric view of the vibration isolation system of FIG. 4 demonstrating the method of measuring the torsional spring rate ($K_t$) of the system.

The effective forcing frequency ($\omega_f$) of the tennis racket needs to be determined, a parameter related to the impulse (shock and vibration) received by the racket when impacting a tennis ball. For the baseball bat, the fundamental bending natural frequency ($\omega$) was used, between about 200 Hz to 600 Hz. However, tennis racket frames have a first mode of vibration range of between about 90 Hz to 200 Hz, and for most rackets between about 120-130 Hz. Much of the shock is absorbed by the stretch of the rackets strings and the compression of the tennis ball. The total duration of impact (t) of a tennis ball on the strings of a racket is between about 5-6 milliseconds (compared to about 1 millisecond for a baseball and bat), yet the time for the shock wave of impact to reach a player's hands on a tennis racket is about 2.5 to 4 milliseconds. Hence, the shock wave reaches the player's hand before the ball leaves the strings of the racket. It is believed that the effective forcing frequency ($\omega_f$) is best determined based on the pulse of the tennis ball impacting the strings of the racket. According to the present invention, the effective forcing frequency ($\omega_f$) is determined by assuming the acceleration pulse of the tennis ball and strings of the racket is a versed sine acceleration pulse. The effective forcing frequency ($\omega_f$) for a tennis racket was determined as follows:

(t) the total duration of pulse (period) t=5 milliseconds, ($t_r$) the effective duration of impulse $t_r=(1/2)\ t=2.5$ milliseconds, and ($\omega_f$) the effective forcing frequency $\omega_f=(2\pi/t_r)=2513$ rad/sec Next, the torsional spring rate ($K_t$) of the vibration isolation system 10 when affixed to the tennis racket is determined. Referring to FIG. 10, the vibration isolation system 10 of the embodiment in FIGS. 4-6 is shown demonstrating how the torsional spring rate ($K_t$) is measured. The outer shell member 20 is held fixed, and a torque (T) is applied to the racket 46 about centerline 32, and an angle of deflection ($\ominus$) measured. The torque (T) is shown by numeral 40, and the angle of deflection ($\ominus$) is shown by numeral 44. The torsional spring rate ($K_t$) is determined from the following equation:

$$K_t=T\div\ominus$$

It is important that the torsional spring rate ($K_t$) be measured under a very small angle of deflection ($\ominus$), preferably no greater than between about 0.25 to 5.0 degrees, otherwise the measured value will be too high and will not be representative of the systems actual torsional spring rate for purposes of the present invention. It is believed that under a small angle of deflection, the spring rate will be generally linear, but at or near maximum deflection the spring rate will increase exponentially. Hence, the torsional spring rate ($K_t$) of the system 10 should be measured within a desired angular deflection range for the system, which for a tennis racket is believed to be between about 0.25 to about 3.0 degrees. One way of determining if the torsional spring rate ($K_t$) was measured correctly is to measure ($K_t$) at a number of different deflection points/angles within the desired angular deflection range for the system. The correct value for ($K_t$) will be the value where they are substantially similar.

With the torsional spring rate ($K_t$) measured, the torsional natural frequency of the vibration isolation system ($\omega_t$) is determined from the following equation:

$$\omega_t=(K_t\div J)^{1/2}$$

With the effective forcing frequency ($\omega_f$) of the tennis racket, and with the torsional natural frequency of the vibration isolation system ($\omega_t$), the ratio of the effective forcing frequency ($\omega_f$) divided by the torsional natural frequency of the vibration isolation system ($\omega_t$) is determined. This ratio ($\omega_f/\omega_t$) must be greater than 1.5 in order for the system 10 to effectively isolate torsional forces from being transmitted to the player's hand(s). As with the previous embodiments, this ratio ($\omega_f/\omega_t$) can also be adjusted by reconfiguring the isolation elements 22 to obtain a lower torsional spring rate ($K_t$) of the vibration isolation system.

For the embodiment shown in FIGS. 4-6, Table 3 shows the values that were determined for a tennis racket.

TABLE 3

| t (sec) | tr (sec) | ωf (rad/sec) | F (lbf) | Off Center Distance (inches) | T (in-lbf) | Θ | J (lbm-in$^2$) | Kt (in-lbf/rad) | ωt (rad/sec) | ωf/ωt |
|---|---|---|---|---|---|---|---|---|---|---|
| 0.005 | 0.0025 | 2513 | 100 | 3 | 300 | 3° | 1.092 | 5730 | 1424 | 1.76 |

From value for the torsional spring rate ($K_t$) determined in Table 3, it is believed that, depending on player preferences, that the range of torsional spring rates ($K_t$) for various tennis rackets will be between about 3,300 and 40,200 in-lb$_f$/rad. For most other hand implements, it is believed that the range of torsional spring rates ($K_t$) will be between about 1,140 and 70,000 in-lb$_f$/rad.

Figure 7:
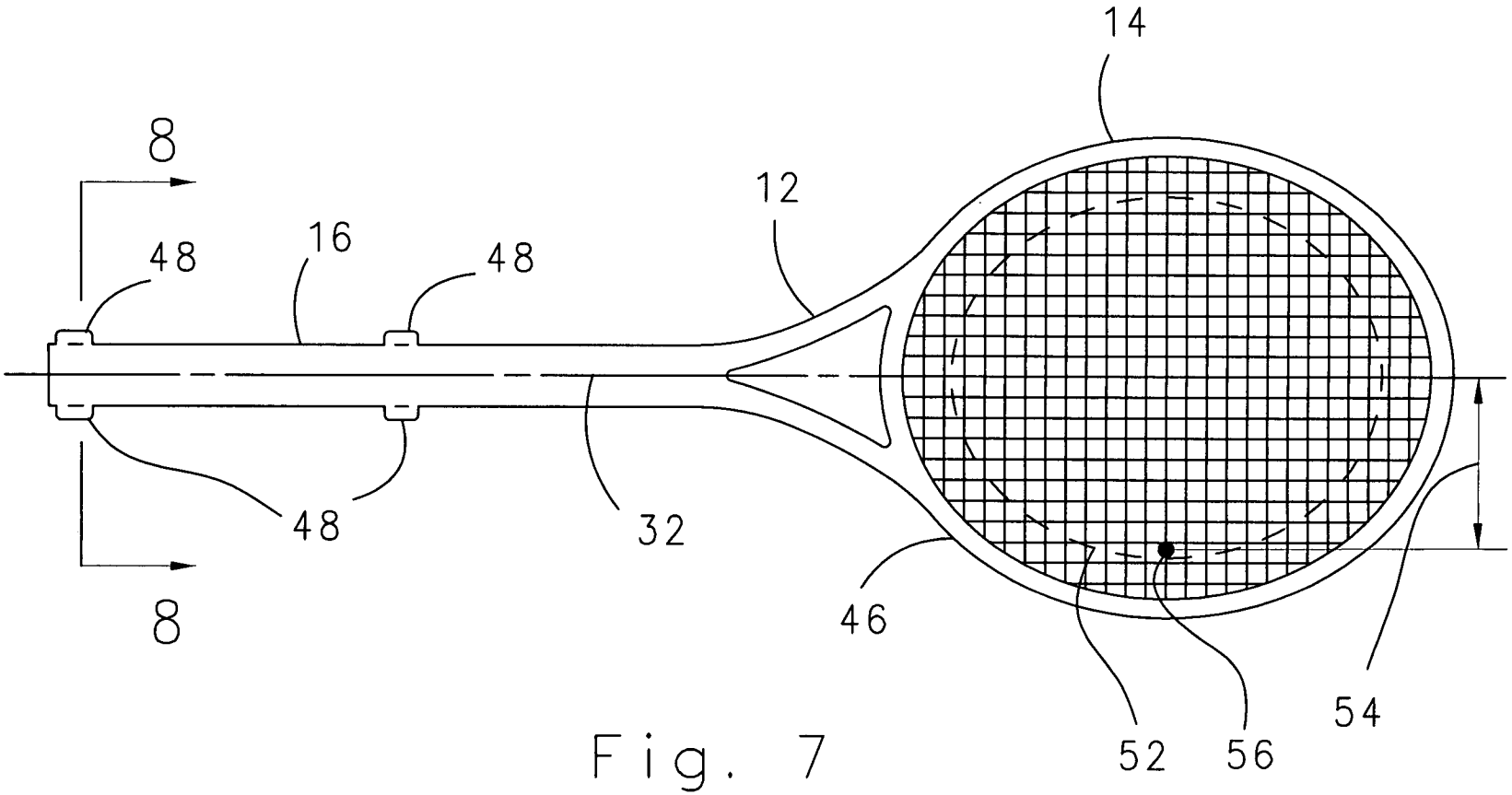
FIG. 7 is a side view of an alternate embodiment of the vibration isolation system of the present invention for a tennis racket shown without the outer shell member, isolation elements, and dust shield.
Figure 8:
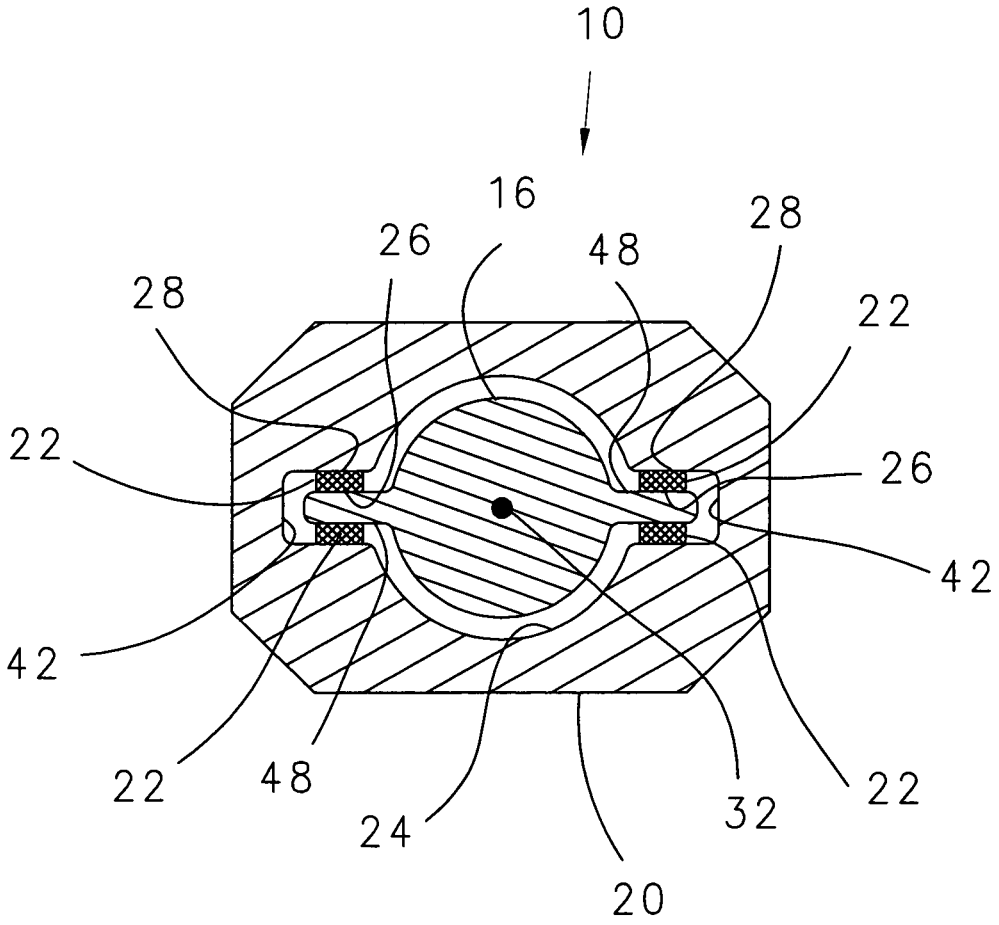
FIG. 8 is a cross-section view taken from FIG. 7 including the outer shell member, isolation elements, and dust shield.

Referring to FIGS. 7-8, an alternate embodiment of the vibration isolation system 10 for a tennis racket is shown. The grip end 16 of the racket 46 is provided with tabs 48, and the outer shell 20 is provided with slots 42 on the inner surface 24. Two isolation elements 22 are provided for each tab 48 and are affixed at their inner mounting surface 26 to a respective tab 48, and at their outer mounting surface 28 to a respective slot 42. As with the previous embodiments, the isolation elements 22 support the outer shell member 20 about the grip end 16, and the outer shell member 20 is sufficiently spaced outwardly from the grip end 16 to allow the grip end 16 and grip end tabs 48 to torsionally deflect within the outer shell member 20 when the tennis racket impacts a tennis ball. In this embodiment, the isolation elements are loaded in tension and compression as the grip end 16 torsionally deflects within the outer shell 20. It is believed this configuration can provide for greater control of the desired deflection range for the system 10. This is accomplished by configuring the isolation elements 22 to provide a maximum torsional spring rate ($K_{tmax}$) for the system. This is achieved by first selecting values for the following parameters:

(F) the maximum average impact force of the tennis racket when impacting a ball, (d) the maximum off-center distance of the tennis racket, and (ϕ) maximum allowable angle of rotation of the tennis racket when impacting a ball.

The maximum average impact force (F) of the tennis racket when impacting an object varies depending on the strength and skill level of the player. Generally, a player can generate an impact force of between about 60 to 120 lbs when striking a tennis ball during a groundstroke. In this embodiment, a maximum average impact force (F) was selected of 100 lbs.

The maximum off-center distance (d) of the tennis racket is the maximum distance away from the centerline 32 of the racket within the intended zone of contact of which the ball hits the strings. This is the furthest point from the centerline 32 on the racket that contact can be made while providing reasonable accuracy in the return of the ball. Referring to FIGS. 4 and 7, the maximum off-center distance (d) is shown by numeral 54, and the off-center impact point is shown by numeral 56 at the maximum distance away from the centerline 32 of the racket within the intended zone of contact 52. According to the present invention, the concern is to minimize torsional forces transmitted to the player's hands/elbow for off-center hits having a reasonable chance of returning in court to a location desired by the player. Hence an maximum off-center distance (d) for a typical tennis racket was determined to be 3 inches.

The maximum allowable angle of rotation (ϕ) of the hand implement when impacting an object is defined herein to be an acceptable maximum twist of the hand implement 12 within the vibration isolation system 10 due to maximum torsion forces transmitted to the system. It is necessary to select this angle as a constraint to maintain the accuracy of the tennis racket in directing the tennis ball to the location that the player desires. Because the tennis ball remains in contact with the strings of the racket while the isolation system 10 rotates, accuracy of the racket can be compromised if the allowable angle of rotation (ϕ) is too great, such as, for example, about 5 degrees or more. Hence, according to the present invention, the allowable angle of rotation (ϕ) for a tennis racket is selected to be 3 degrees.

The maximum torsional spring rate ($K_{tmax}$) is calculated as follows:

$$K_{tmax}=(F\cdot d)\div\phi$$

and the calculated ($K_{tmax}$) is then compared to an actual measurement of ($K_{tmax}$) following the method discussed in measuring ($K_t$) shown in FIG. 10. In contrast to measuring ($K_t$) under a small deflection angle, ($K_{tmax}$) is measured by increasing the force 40 until the deflection reaches the maximum allowable angle of rotation (ϕ) of 3 degrees. The isolation elements can then be reconfigured to get the measured ($K_{tmax}$) as close to the calculated ($K_{tmax}$) as desired.

It is to be appreciated that the measured ($K_{tmax}$) may be the same value, or nearly the same, as the measured ($K_t$) value. This would be the case if the torsional spring rate remains linear throughout the allowable angle of rotation range of the hand implement, as is believed to be the case in the embodiment shown in FIGS. 4-6. However, in the embodiment shown in FIGS. 7-8, ($K_{tmax}$) may be greater than ($K_t$) as the isolation elements may "bottom out" when loaded in compression due to maximum torque loads on the system. For purposes of the present invention, the measured value of ($K_{tmax}$) should not be used in determining the ratio ($\omega_f/\omega_t$) unless it is identical to the value measured for ($K_t$).

The embodiments of the vibration isolation system 10 shown in FIGS. 4-8 for a tennis racket not only isolate torsional forces from being transmitted to the player's hand(s), they also have the advantage of being able to increase racket control. The duration of time that a ball is in contact with the strings of a racket depends significantly on the tension in the strings of the racket. A tennis racket strung in high tension will have a smaller duration of time that the ball is in contact with the strings than a tennis racket strung with low tension. The duration of time that the ball is in contact with the strings, the racket rotates through a swing angle generated by the player. For a tennis racket strung in high tension, the swing angle will be less than a tennis racket strung in low tension. The higher the string tension, the lower the swing angle, and the greater the racket control is for the player. Unfortunately, the higher the string tension, the greater the recoil force is transmitted to the player. According to the present invention, the recoil force will angularly deflect the grip end 16 with respect to the outer shell member 20 thereby reducing the swing angle by this amount of deflection. Therefore, according to the present invention, racket control is increased for any given racket because the swing angle is reduced.

It is to be appreciated that the vibration isolation system 10 of the present invention can be tuned for different hand implements. The system can be tuned to account for bending vibration, as demonstrated with the bat, recoil, as demonstrated with the tennis racket, and twist, as also demonstrated with the tennis racket. Further, the system 10 can be tuned to account for all three; bending vibration, recoil, and twist.

What has been described are preferred embodiments of a vibration isolation system. Those skilled in the art will appreciate that numerous modifications are possible without materially departing from the novel teachings and advantages of the subject matter described herein. Other modifications, substitutions, changes, and omissions may be made in the design and arrangement of the preferred and other exemplary embodiments without departing from the spirit of the present invention.

What is claimed is:

1. A vibration isolation system for a hand implement having a grip end and a impact end, the hand implement having a fundamental bending natural frequency ($\omega$) and a mass (m), the vibration isolation system comprising:

a outer shell member having an inner surface substantially encircling and spaced outwardly from the grip end, the outer shell member sufficiently spaced outwardly from the grip end allowing the grip end to freely deflect within the outer shell member when the impact end of the hand implement impacts an object within an intended zone of contact; and, at least two isolation elements positioned between the grip end and the outer shell member and supporting the outer shell member about the grip end, each isolation element having an inner mounting surface and an outer mounting surface, the inner mounting surface affixed to the grip end of the hand implement and the outer mounting surface affixed to the inner surface of the outer shell member, the isolation elements establishing a spring rate (k) of the vibration isolation system when the system is affixed to the hand implement, the square root of the spring rate (k) divided by the mass (m) of the hand implement defines a natural frequency of the vibration isolation system ($\omega_o$), ($\omega_o=(k\div m)^{1/2}$), wherein the ratio of the fundamental bending natural frequency ($\omega$) divided by the natural frequency of the vibration isolation system ($\omega_o$) is greater than 1.5; and, the isolation elements having a footprint length and the outer shell member having a length that is at least 2 times greater than the footprint length of the isolation elements.

2. The vibration isolation system of claim 1 wherein the hand implement is an aluminum baseball bat having a fundamental bending natural frequency ($\omega$) of between about 200 to 600 Hz.

3. The vibration isolation system of claim 2 wherein the ratio of the fundamental bending natural frequency ($\omega$) divided by the natural frequency of the vibration isolation system ($\omega_o$) is greater than about 8.0.

4. The vibration isolation system of claim 2 wherein the outer shell member is sufficiently spaced outwardly from the grip end by at least about 0.090 inches allowing the grip end to freely deflect within the outer shell member when the impact end of the hand implement impacts an object within an intended zone of contact.

5. The vibration isolation system of claim 1 wherein the hand implement is a wooden baseball bat having a fundamental bending natural frequency ($\omega$) of between about 120 to 250 Hz.

6. The vibration isolation system of claim 1 wherein the isolation element is a material selected from the group comprising elastomers, rubber, foam, or plastic.

7. The vibration isolation system of claim 6 wherein the isolation element material is open cell ethylene vinyl acetate rubber.

8. The vibration isolation system of claim 1 wherein the isolation elements have a footprint length and the outer shell member has a length along the inner surface that is at least 2 times greater than the footprint length.

9. The vibration isolation system of claim 1 wherein the outer shell member is a material selected from the group comprising metal, plastic, or hard rubber.

10. The vibration isolation system of claim 1 wherein the hand implement is a softball bat.

11. A vibration isolation system for a hand implement having a grip end and a impact end, the hand implement having a polar moment of inertia (J) about the centerline of the grip end and an effective forcing frequency ($\omega_f$) based on the effective duration of impulse when impacting an object, the vibration isolation system comprising:

a outer shell member having an inner surface substantially encircling and spaced outwardly from the grip end, the outer shell member sufficiently spaced outwardly from the grip end allowing the grip end to torsionally deflect within the outer shell member when the impact end of the hand implement impacts an object within an intended zone of contact;

at least one isolation element positioned between the grip end and the outer shell member and supporting the outer shell member about the grip end, the isolation element having an inner mounting surface and an outer mounting surface, the inner mounting surface affixed to the grip end of the hand implement and the outer mounting surface affixed to the inner surface of the outer shell member, the isolation element establishing a torsional spring rate ($K_t$) of the vibration isolation system when the system is affixed to the hand implement; and, wherein the square root of the torsional spring rate ($K_t$) divided by the polar moment of inertia (J) of the hand implement defines a torsional natural frequency of the vibration isolation system ($\omega_t$), ($\omega_t=(K_t\div J)^{1/2}$), and the ratio of the effective forcing frequency ($\omega_f$) divided by the torsional natural frequency of the vibration isolation system ($\omega_t$) is greater than 1.5.

12. The vibration isolation system of claim 11 wherein the system has a maximum torsional spring rate ($K_{tmax}$) based on, in combination:

a selected maximum average impact force (F) of the hand implement when impacting an object;

a selected maximum off-center distance (d) of the hand implement when impacting an object; and a selected maximum allowable angle of rotation ($\Phi$) of the hand implement when impacting an object.

13. The vibration isolation system of claim 11 wherein the maximum torsional spring rate ($K_{tmax}$) is substantially the same value as the torsional spring rate ($K_t$).

14. The vibration isolation system of claim 11 wherein the maximum torsional spring rate ($K_{tmax}$) is greater than the value of the torsional spring rate ($K_t$).

15. The vibration isolation system of claim 11 wherein there are at least two isolation elements.

16. The vibration isolation system of claim 11 wherein the isolation element has a torsional spring ($K_t$) of between about 1,140 and 70,000 in-lbf/rad.

17. The vibration isolation system of claim 11 wherein the hand implement is a tennis racket and the isolation element has a torsional spring ($K_t$) of between about 3,300 and 40,200 in-lbf/rad.

18. The vibration isolation system of claim 11 wherein the hand implement is a tennis racket; and, wherein the grip end further comprises at least one tab, the inner surface of the outer shell member having at least one slot encircling the tab, the inner mounting surface of the isolation element affixed to the tab and the outer mounting surface of the isolation element affixed to the slot.

19. The vibration isolation system of claim 18 wherein there are two slots, each slot encircling two tabs, and there are two isolation elements for each tab.

20. A vibration isolation system for a baseball bat having a grip end and a impact end, the baseball bat having a fundamental bending natural frequency (ω) and a mass (m), the vibration isolation system comprising:

a outer shell member having an inner surface substantially encircling and spaced outwardly from the grip end, the outer shell member sufficiently spaced outwardly from the grip end allowing the grip end to freely deflect within the outer shell member when the impact end of the hand implement impacts an object within an intended zone of contact;

at least two isolation elements positioned between the grip end and the outer shell member and supporting the outer shell member about the grip end, each isolation element having an inner mounting surface and an outer mounting surface, the inner mounting surface affixed to the grip end of the hand implement and the outer mounting surface affixed to the inner surface of the outer shell member, the isolation elements establishing a spring rate (k) of the vibration isolation system when the system is affixed to the hand implement, the square root of the spring rate (k) divided by the mass (m) of the hand implement defines a natural frequency of the vibration isolation system ($\omega_o$), ($\omega_o=(k\div m)^{1/2}$), wherein the ratio of the fundamental bending natural frequency (ω) divided by the natural frequency of the vibration isolation system ($w_o$) is greater than 1.5; and, the isolation elements having a footprint length and the outer shell member having a length that is at least 2 times greater than the footprint length of the isolation elements.

21. The vibration isolation system of claim 20 wherein the baseball bat is aluminum having a fundamental bending natural frequency (ω) of between about 200 to 600 Hz.

22. The vibration isolation system of claim 21 wherein the ratio of the fundamental bending natural frequency (ω) divided by the natural frequency of the vibration isolation system ($\omega_o$) is greater than about 8.0.

23. The vibration isolation system of claim 21 wherein the outer shell member is sufficiently spaced outwardly from the grip end by at least about 0.090 inches allowing the grip end to freely deflect within the outer shell member when the impact end of the hand implement impacts an object within an intended zone of contact.

24. The vibration isolation system of claim 20 wherein the baseball bat is wooden having a fundamental bending natural frequency (ω) of between about 120 to 250 Hz.

25. The vibration isolation system of claim 20 wherein the length of the outer shell member is at least 6 times greater than the footprint length of the isolation elements.

26. The vibration isolation system of claim 20 wherein the outer shell member has an integral knob surrounding the grip end of the baseball bat.

* * * * *